US006644161B2

(12) United States Patent
Lin

(10) Patent No.: US 6,644,161 B2
(45) Date of Patent: Nov. 11, 2003

(54) PAPER PUNCH WITH MULTIPLE PUNCH HEADS

(75) Inventor: Chien-Fu Lin, Taichung (TW)

(73) Assignee: Gino Lu (TW)

( * ) Notice: Subject to any disclaimer, the term of this patent is extended or adjusted under 35 U.S.C. 154(b) by 0 days.

(21) Appl. No.: 10/035,269

(22) Filed: Jan. 3, 2002

(65) Prior Publication Data

US 2003/0121383 A1 Jul. 3, 2003

(51) Int. Cl.[7] ..... B26F 1/14

(52) U.S. Cl. ..... 83/588; 83/613; 83/687; 83/691

(58) Field of Search ..... 83/618, 588, 687, 83/523, 613, 691, 167; 411/403

(56) References Cited

U.S. PATENT DOCUMENTS 2,534,094 A * 12/1950 Yerkes ..... 83/449
3,073,199 A * 1/1963 Yerkes ..... 83/549
3,748,940 A * 7/1973 Muri ..... 83/414
4,700,601 A * 10/1987 Simon ..... 83/687
4,713,995 A * 12/1987 Davi ..... 83/167
5,017,069 A * 5/1991 Stencel ..... 411/403
6,032,566 A * 3/2000 Evans et al. ..... 83/618

* cited by examiner

*Primary Examiner*—Allan N. Shoap
*Assistant Examiner*—Ghassem Alie
(74) *Attorney, Agent, or Firm*—Charles E. Baxley

(57) ABSTRACT

A paper punch includes a base having a protrusion on a top thereof and three passages are defined vertically through the protrusion. Each of the passages has a punch head assembly received therein. A gap is defined between the protrusion and the top of the base. A handle has a groove defined therethrough and an index member is movably engaged with the groove so that the index member can be moved to a position above the chosen punch head assembly which is moved downward to punch papers in the gap by pivoting the handle.

6 Claims, 4 Drawing Sheets

PAPER PUNCH WITH MULTIPLE PUNCH HEADS

FIELD OF THE INVENTION

The present invention relates to a paper punch having three punch heads and an index member is movably connected to the handle so as to use the chosen punch head as desired.

BACKGROUND OF THE INVENTION

A conventional paper punch generally includes a base and a handle which is pivotally connected to the base. Three punch heads is vertically movable connected between the handle and the base. The punch heads are pushed downward to punch papers by pushing the handle. The punch heads have a fixed and unchanged shape so that the users can only obtain the fixed shape of holes by using the paper punch. Other paper punches should be purchased if the users want to have different shapes of holes in their papers.

SUMMARY OF THE INVENTION

In accordance with one aspect of the present invention, there is provided a paper punch which comprises a base having a protrusion on a top of the base and at least two passages are defined vertically through the protrusion. Each of the at least two passages has a punch head assembly received therein. A gap is defined between the protrusion and the top of the base. A handle has a groove defined therethrough and an index member is movably engaged with the groove.

The primary object of the present invention is to provide a paper punch having multiple punch heads and the shape of the punch head can be chosen.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
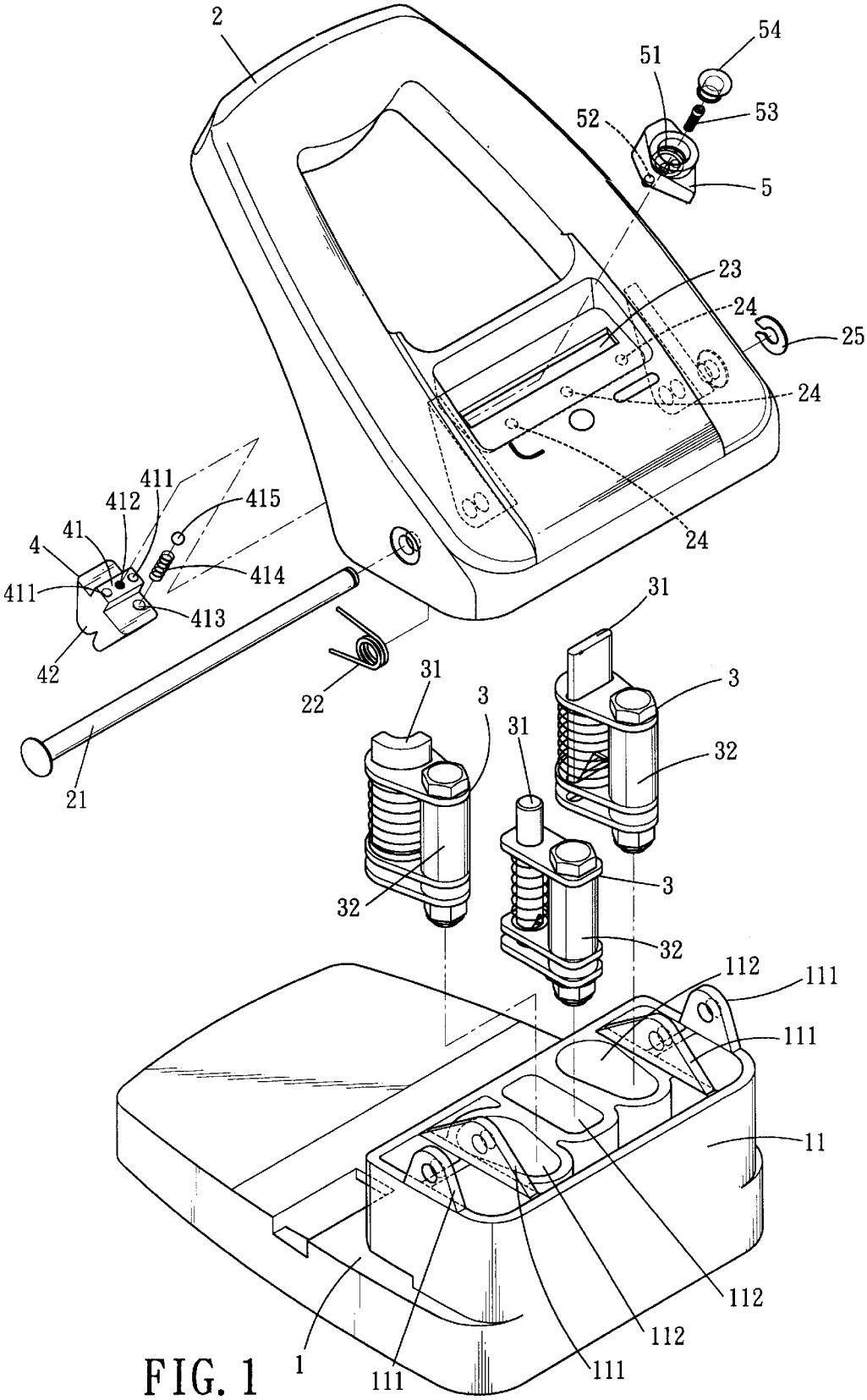
FIG. 1 is an exploded view to show the paper punch of the present invention.
Figure 2:
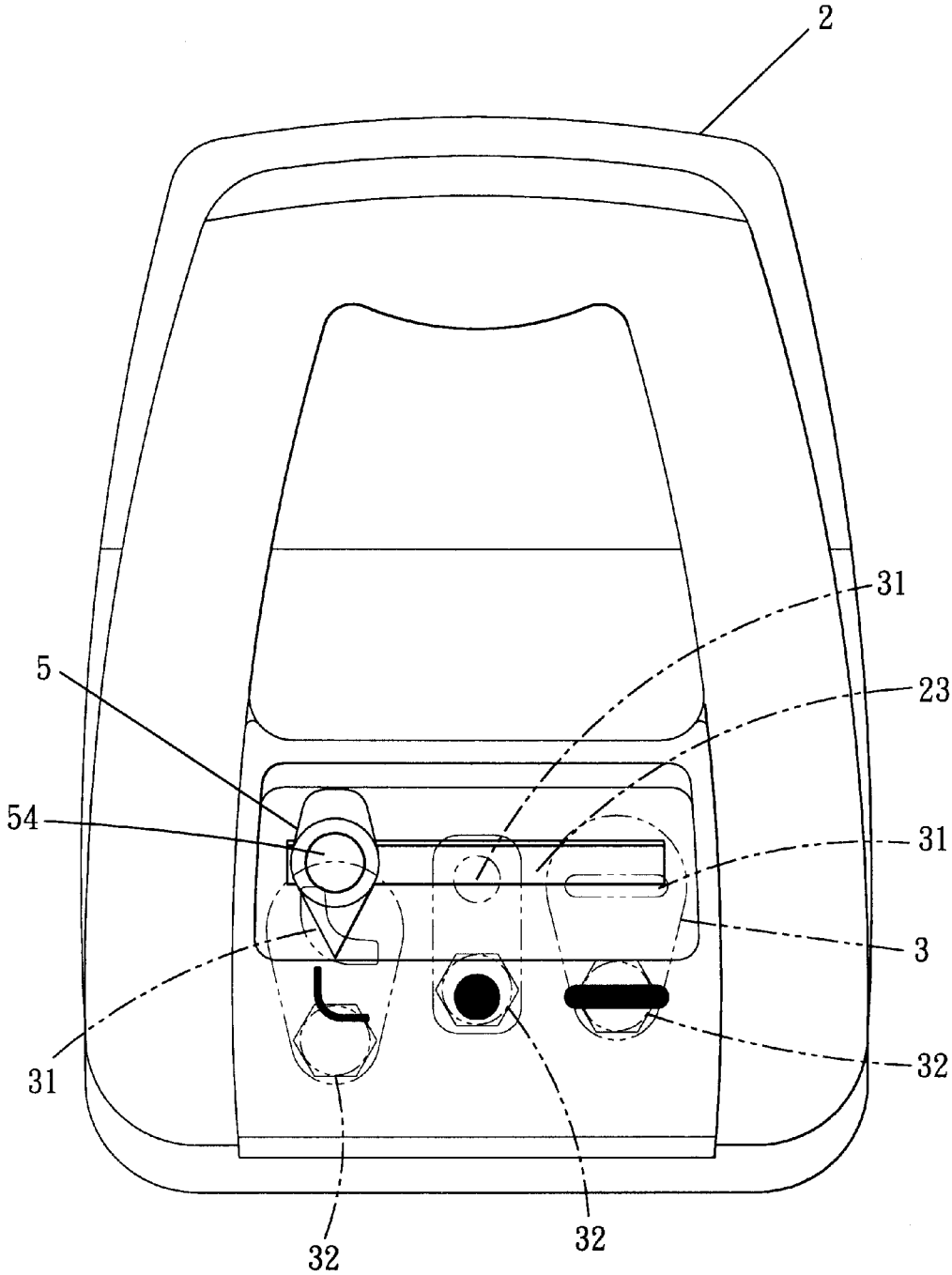
FIG. 2 is a top view to show the arrangement of the index member and the punch head assemblies of the paper punch of the present invention.
Figure 3:
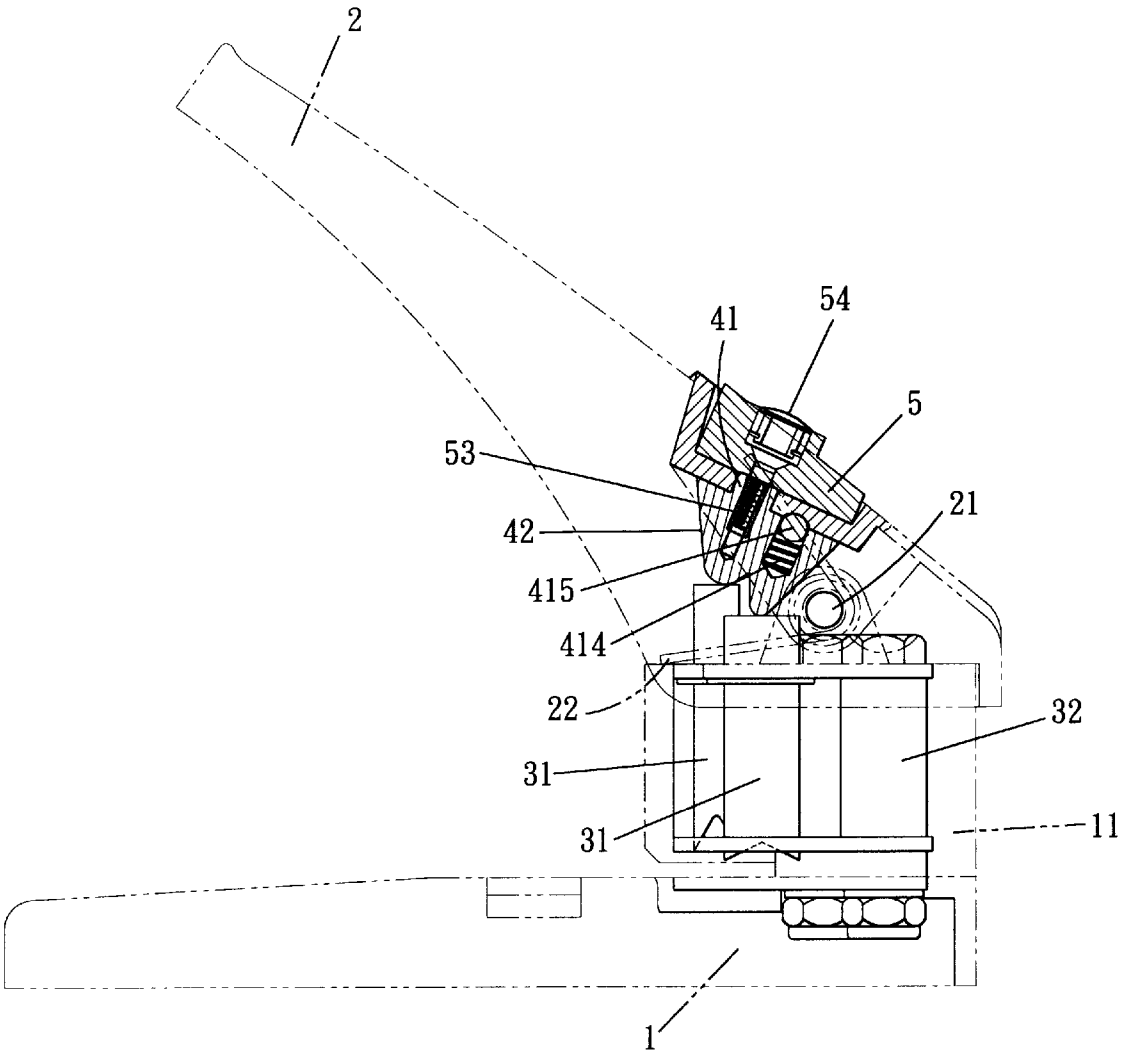
FIG. 3 is a side view to show the paper punch of the present invention.

Referring to FIGS. 1 to 3, the paper punch of the present invention comprises a base 1 and a handle 2 which is pivotally connected to the base 1 by a rod 21 and a torsion spring 22 mounted to the rod 21. A protrusion 11 extends from a top of the base 1 and a gap is defined between the protrusion 11 and the top of the base 1 so that papers to be punched is inserted in the gap. Three passages 112 are defined vertically through the protrusion 11 and each of the passages 112 has a punch head assembly 3 received therein. Two pairs of lugs 111 extend from a top of the protrusion 11 and the handle 2 is pivotally connected to the lugs 111. Each punch head assembly 3 includes a base member 32 and a punch blade 31. A top of the punch blade 31 is higher than a top of the base member 32.

The handle 2 has a groove 23 defined through a plate connected between two extensions of the U-shaped handle 2. The groove 23 is located in alignment with the at least two passages 112 when the handle 2 is not pivoted. Three notches 24 are defined in an underside of the plate of the handle 2.

An index member 4 is movably engaged with the groove 23 and has a ridge 41 which is engaged with the groove 23. A knob 5 is movably mounted on the plate of the handle 2 and fixed to the ridge 41 by extending a screw 53 through a hole 51 defined through the knob 5 and being engaged with a threaded hole 412 defined in the ridge 41. The index member 4 further has two positioning holes 411 defined in the ridge 41 and the knob 5 has two insertions 52 which are inserted in the two positioning holes 411. A decoration member 54 is used to close the hole 51 in the knob 5. A recess 413 is defined in the index member 4 and a spring 414 and a ball 415 are received therein. The ball 415 is movably engaged with one of the notches 24. Therefore, the index member 4 is moved above a desired punch head assembly 3 by shifting the knob 5 and when the ball 415 is engaged with the notch 24, the index member 4 is positioned. Two peaks 42 extend from an underside of the index member 4 and respectively contact two respective tops of the base member 32 and the punch blade 31.

Figure 4:
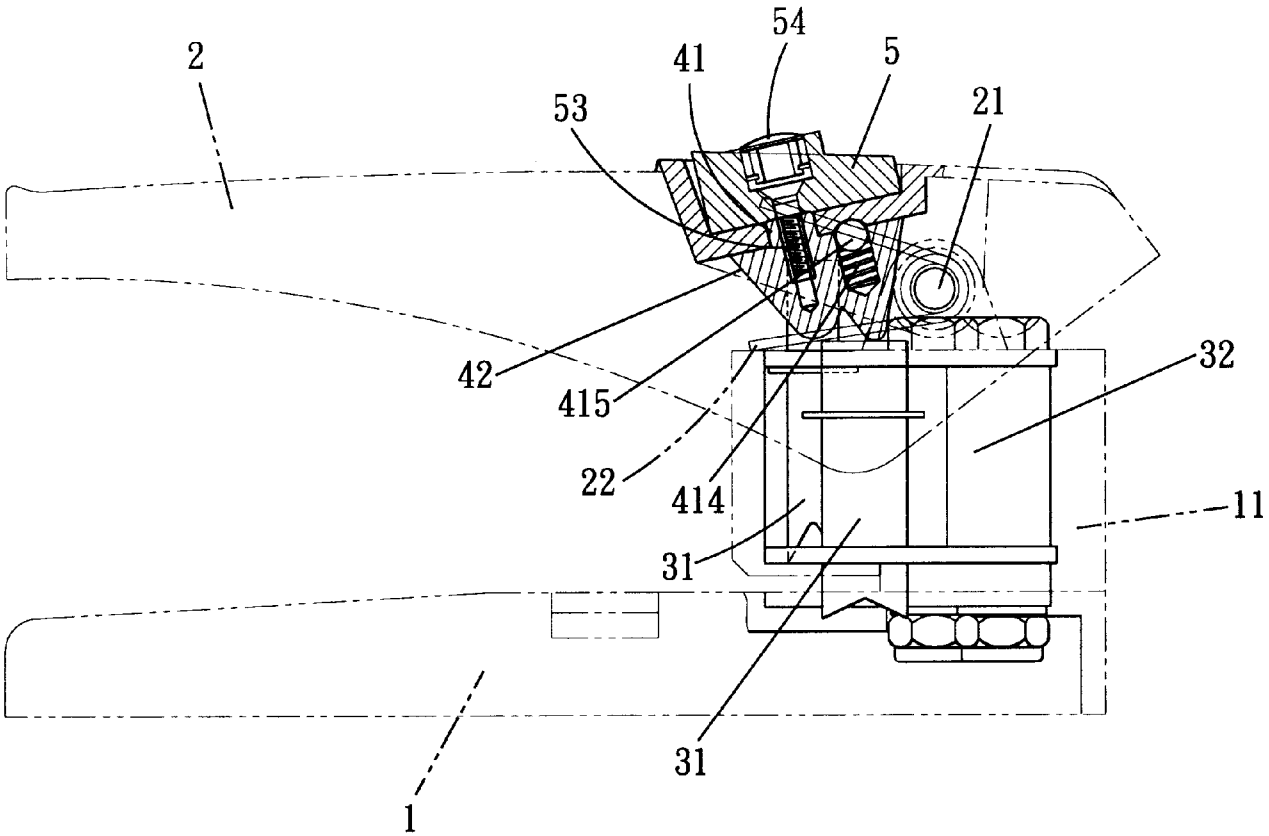
FIG. 4 is a side view to show that the handle is pushed downward to move one of the punch head assemblies toward the base.

As shown in FIG. 4, when pushing the handle 2, the index member 4 pushes the chosen punch head assembly 3 to punch the papers in the gap.

While we have shown and described the embodiment in accordance with the present invention, it should be clear to those skilled in the art that further embodiments may be made without departing from the scope of the present invention.

What is claimed is:

1. A paper punch comprising:

a base having a protrusion on a top of said base and at least two passages defined vertically through said protrusion each of said at least two passages having a punch head assembly received therein, a gap defined between said protrusion and said top of said base, and a handle having a groove defined therethrough and said groove located in alignment with said at least two passages, an index member having a ridge which is movably engaged with said groove and a knob movably mounted on said handle and fixed to said ridge.

2. The paper punch as claimed in claim 1 wherein each punch head assembly includes a base member and a punch blade, a top of said punch blade being higher than a top of said base member, two peaks extending from an underside of said index member and respectively contacting two respective tops of said base member and said punch blade.

3. The paper punch as claimed in claim 1 wherein said index member has two positioning holes defined in said ridge and said knob has two insertions which are inserted in said two positioning holes.

4. A paper punch comprising:

a base having a protrusion on a top of said base and at least two passages defined vertically through said protrusion and each of said at least two passages having a punch head assembly received therein, a gap defined between said protrusion and said top of said base, each punch head assembly including a base member and a punch blade, a top of said punch blade being higher than a top of said base member, and a handle having a groove defined therethrough and said groove located in alignment with said at least two passages, an index member movably engaged with said groove, two peaks extending from an underside of said index member and respectively contacting two respective tops of said base member and said punch blade.

5. The paper punch as claimed in claim 4, wherein said index member has a ridge which is engaged with said groove and a knob is movably mounted on said handle and fixed to said ridge.

6. The paper punch as claimed in claim 5 wherein said index member has two positioning holes defined in said ridge and said knob has two insertions which are inserted in said two positioning holes.

* * * * *